US006126715A

United States Patent [19]

Luk

[11] Patent Number: 6,126,715

[45] Date of Patent: Oct. 3, 2000

[54] IRON-BASED POWDER COMPOSITIONS CONTAINING GREEN STRENGTH ENHANCING LUBRICANT

[75] Inventor: Sydney Luk, Lafayette Hill, Pa.

[73] Assignee: Hoeganaes Corporation, Riverton, N.J.

[21] Appl. No.: 09/477,835

[22] Filed: Jan. 5, 2000

Related U.S. Application Data

[62] Division of application No. 08/820,371, Mar. 12, 1997, Pat. No. 6,039,784.

[51] Int. Cl.[7] ..... B22F 9/02

[52] U.S. Cl. ..... 75/351; 148/513; 419/66

[58] Field of Search ..... 75/231, 246, 351; 148/513; 419/66

[56] References Cited

U.S. PATENT DOCUMENTS

| | | | |
|---|---|---|---|
| 4,268,599 | 5/1981 | Russell | 106/308 M |
| 4,362,559 | 12/1982 | Perez et al. | 75/53 |
| 4,483,905 | 11/1984 | Engström | 428/570 |
| 4,491,559 | 1/1985 | Grab et al. | 419/36 |
| 4,502,982 | 3/1985 | Horie et al. | 524/440 |
| 4,504,441 | 3/1985 | Kuyper | 419/35 |
| 4,545,926 | 10/1985 | Fouts, Jr. et al. | 252/511 |
| 4,601,765 | 7/1986 | Soileau et al. | 148/104 |
| 4,634,627 | 1/1987 | Fujiki et al. | 428/900 |
| 4,676,831 | 6/1987 | Engström | 75/252 |
| 4,721,599 | 1/1988 | Nakamura | 419/23 |
| 4,735,734 | 4/1988 | Staub et al. | 252/29 |
| 4,834,800 | 5/1989 | Semel | 106/403 |
| 4,921,665 | 5/1990 | Klar et al. | 419/23 |
| 4,946,499 | 8/1990 | Sakuranda et al. | 75/343 |
| 4,955,798 | 9/1990 | Museila et al. | 419/31 |
| 4,976,778 | 12/1990 | Berry et al. | 75/254 |
| 5,063,011 | 11/1991 | Rutz et al. | 264/126 |
| 5,069,714 | 12/1991 | Gosselin | 75/252 |
| 5,098,942 | 3/1992 | Menke et al. | 524/314 |
| 5,108,493 | 4/1992 | Causton | 75/255 |
| 5,125,990 | 6/1992 | Iwasaki et al. | 148/302 |
| 5,198,137 | 3/1993 | Rutz et al. | 252/62.54 |
| 5,225,459 | 7/1993 | Oliver et al. | 523/220 |
| 5,256,185 | 10/1993 | Semel et al. | 75/255 |
| 5,290,336 | 3/1994 | Luk | 75/231 |
| 5,298,055 | 3/1994 | Semel et al. | 75/252 |
| 5,472,661 | 12/1995 | Gay | 419/36 |
| 5,498,276 | 3/1996 | Luk | 75/252 |
| 5,538,684 | 7/1996 | Luk et al. | 419/66 |
| 5,767,426 | 6/1998 | Oliver et al. | 75/246 |
| 5,976,215 | 11/1999 | Uenosono et al. | 75/252 |
| 5,980,603 | 11/1999 | Thomas et al. | 75/252 |
| 6,039,784 | 3/2000 | Luk | 75/252 |
| 6,051,184 | 4/2000 | Kanakawa | 419/36 |

*Primary Examiner*—George Wyszomierski
*Attorney, Agent, or Firm*—Woodcock Washburn Kurtz Mackiewicz & Norris

[57] ABSTRACT

Metallurgical powder compositions are provided that contain a metal powder that is associated with a polymeric material in admixture with a solid, particulate polyether lubricant. The incorporation of the polyether lubricant enhances the green strength properties of compacted parts made from the powder compositions, and generally reduces the ejection forces required to remove the compacted part from the die cavity.

12 Claims, No Drawings

IRON-BASED POWDER COMPOSITIONS CONTAINING GREEN STRENGTH ENHANCING LUBRICANT

This application is a divisional of application Ser. No. 08/820,371 filed Mar. 12, 1997, now U.S. Pat. No. 6,039,784.

FIELD OF THE INVENTION

This invention relates to iron-based, metallurgical powder compositions, and more particularly, to powder compositions that include a thermoplastic polymeric material and an improved solid lubricant for enhancing the green strength characteristics of resultant compacted parts.

BACKGROUND OF THE INVENTION

Iron-based particles have long been used as a base material in the manufacture of structural components by powder metallurgical methods. The iron-based particles are first molded in a die under high pressures in order to produce the desired shape. After the molding step, the structural component usually undergoes a sintering step to impart the necessary strength to the component.

Magnetic core components have also been manufactured by such powder metallurgical methods, but the iron-based particles used in these methods are generally coated with a circumferential layer of insulating material. These compacted components generally are not sintered because that heating process would destroy the insulating material.

Two important characteristics of an iron core component are its magnetic permeability and core loss characteristics. The magnetic permeability of a material is an indication of its ability to become magnetized, or its ability to carry a magnetic flux. Permeability is defined as the ratio of the induced magnetic flux to the magnetizing force or field intensity. When a magnetic material is exposed to a rapidly varying field, the total energy of the core is reduced by the occurrence of hysteresis losses and/or eddy current losses. The hysteresis loss is brought about by the necessary expenditure of energy to overcome the retained magnetic forces within the iron core component. The eddy current loss is brought about by the production of electric currents in the iron core component due to the changing flux caused by alternating current conditions.

Research in the powder metallurgical manufacture of magnetic core components using coated iron-based powders has been directed to the development of iron powder compositions that enhance certain physical and magnetic properties without detrimentally affecting other properties. Desired properties include a high permeability through an extended frequency range, high pressed strength, low core losses, and suitability for compression molding techniques.

When molding a core component for AC power applications, it is generally required that the iron particles have an electrically insulating coating to decrease core losses. The use of a plastic coating over the iron particles (see, for example, U.S. Pat. No. 5,198,137 to Rutz et al.) and the use of doubly-coated iron particles (see U.S. Pat. No. 4,601,765 to Soileau et al.) have been employed to insulate the iron particles and therefore reduce eddy current losses. It has also been shown that the insulating coating provided by a polymeric material can be achieved by bonding the polymeric material to the iron-based powder (see U.S. Pat. No. 5,225,459 to Oliver et al.).

The compaction of the powder metallurgical compositions is carried out within a die cavity that is subjected to extreme pressures. To avoid excessive wear on the die cavity, lubricants are commonly used during the compaction process. Lubricants can be generally classified into two groups: internal (dry) lubricants and external (spray) lubricants. The internal lubricants are admixed with the metal-based powder composition, and the external lubricants are sprayed onto the die cavity prior to compaction. Lubricants are used to reduce internal friction between particles during compaction, to permit easier ejection of the compact from the die cavity, to reduce die wear, and/or to allow more uniform compaction of the metal powder blend. Common lubricants include solids such as metallic stearates or synthetic waxes.

As will be recognized, most known internal lubricants reduce the green strength of the compact. It is believed that during compaction the internal lubricant is exuded between iron and/or alloying metal particles such that it fills the pore volume between the particles and interferes with particle-to-particle bonding. Indeed, some shapes cannot be pressed using known internal lubricants. Tall, thin-walled bushings, for example, require large amounts of internal lubricant to overcome die wall friction and reduce the required ejection force. Such levels of internal lubricant, however, typically reduce green strength to the point that the resulting compacts crumble upon ejection. Also, internal lubricants such as zinc stearate often adversely affect powder flow rate and apparent density, as well as green density of the compact, particularly at higher compaction pressures. Moreover, excessive amounts of internal lubricants can lead to compacts having poor dimensional integrity, and volatized lubricant can form soot on the heating elements of the sintering furnace. To avoid these problems, it is known to use an external spray lubricant rather than an internal lubricant. However, the use of external lubricants increases the compaction cycle time and leads to less uniform compaction.

Accordingly, there exists a need in the art for metallurgical powder compositions used for magnetic applications that can be readily compacted to strong green parts that are easily ejected from die cavities without the need for an external lubricant.

SUMMARY OF THE INVENTION

The present invention provides metallurgical powder compositions comprising a metal-based powder that has associated therewith a polymeric material, and an improved solid lubricant component. The improved solid lubricant component enhances one or more physical properties of the powder mixture such as flow, compressibility, and green strength. One benefit of the present invention is that metallurgical powder compositions can be prepared in a solventless blending operation. These compositions can be compacted at relatively low pressures into parts having high green strengths. Since compacts made from the present powder compositions require less force for ejection from molds and dies, there is less wear and tear on tooling.

The improved solid lubricant component comprises a solid, particulate polyether, such as those compounds having more than one subunit of a formula:

$$-[O(CH_2)_q]_n-OH$$

wherein q is from about 1 to about 7. More preferred are solid, particulate polyethers having a formula:

$$H-[O(CH_2)_q]_n-OH$$

wherein q is from about 1 to about 7 and n is selected such that the polyether has a weight average molecular weight greater than 10,000. Preferably, q is 2 and n is selected such that the polyether has a weight average molecular weight from about 10,000 to about 4,000,000, more preferably about 20,000 to about 3,000,000, and even more preferably about 20,000 to about 300,000.

The metallurgical powder compositions can be prepared by admixing the polymeric-containing metal-based powder and the solid lubricant component, using conventional blending techniques, provided that the polyether lubricant remains in the final mixture in particulate form. The metallurgical powder compositions can be compressed into compacts in a die according to standard powder metallurgy techniques.

DETAILED DESCRIPTION OF THE INVENTION

The present invention relates to improved metallurgical powder compositions, methods for the preparation of those compositions, and methods for using those compositions to make compacted parts. The powder compositions comprise a metal-based powder that is associated with a polymeric material, in admixture with an improved solid lubricant component that contains a solid polyether, in particulate form, having a weight average molecular weight between about 10,000 and about 4,000,000. It has been found that the use of the particulate polyether as a lubricant for the metallurgical powder composition provides improved strength and ejection performance of the green compact while maintaining equivalent or superior compressibility relative to the use of other lubricants.

The metallurgical powder compositions of the present invention comprise metal powders of the kind generally used in the powder metallurgy industry, such as iron-based powders and nickel-based powders. The metal powders constitute a major portion of the metallurgical powder composition, and generally constitute at least about 85 weight percent, preferably at least about 90 weight percent, and more preferably at least about 95 weight percent of the metallurgical powder composition.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders.

The particles of iron or pre-alloyed iron can have a weight average particle size as small as one micron or below, or up to about 850–1,000 microns, but generally the particles will have a weight average particle size in the range of about 10–500 microns. Preferred are iron or pre-alloyed iron particles having a maximum weight average particle size up to about 350 microns; more preferably the particles will have a weight average particle size in the range of about 25–150 microns, and most preferably 80–150 microns.

The metal powder used in the present invention can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders.

The metal-based particles can first be coated with an insulative inorganic material to provide an inner coating prior to the application of the polymeric material. This inner coating is preferably no greater than about 0.2% by total weight of the coated particle. Such inner coatings include iron phosphate, such as disclosed in U.S. Pat. No. 5,063,011 to Rutz et al, and alkaline metal silicates, such as disclosed in U.S. Pat. No. 4,601,765 to Soileau et al. The disclosure of each of these patents is hereby incorporated by reference in its entirety.

The polymeric material can be associated with the metal-based powder particles by various methods known to the art. One such method is to coat the polymeric material onto the metal-based particles by means of a fluidized bed application process such as that described in U.S. Pat. No. 5,198,137 to Rutz et al, which is hereby incorporated in its entirety by reference. Another method is to bond the polymeric material onto the metal-based particles as described in U.S. Pat. No. 5,225,459 to Oliver et al., which is hereby incorporated by reference in its entirety.

Any polymeric material that can be sufficiently softened and/or dissolved by a solvent so as to be able to coat onto or bond to the surfaces of the metal-based particles can be used in this invention. Preferred polymeric materials are thermoplastic materials, particularly those that have a weight average molecular weight in the range of about 10,000 to 50,000. More preferred are thermoplastic polymers of such a molecular weight range that have a glass transition temperature in the range of about 175–450° F. (about 80–230° C.). Examples of the thermoplastic material are polyetherimides, polyphenylene ethers, polyethersulfones, polycarbonates, polyethylene glycol, polyvinyl acetate, and polyvinyl alcohol.

Suitable polycarbonates that can be utilized as a thermoplastic in the present invention are bisphenol-A-polycarbonates, also known as poly(bisphenol-A-carbonate). These polycarbonates have a specific gravity range of about 1.2 to 1.6. A specific example is poly (oxycarbonyloxy-1,4-phenylene-(1-methylethlidene)-1,4-phenylene) having an empirical formula of $(C_{16}H_{14}O_3)n$ where n is an integer of about 30–60. Commercially available polycarbonates are the LEXAN resins from General Electric Company. The most preferred LEXAN resins are the LEXAN 121 and 141 grades.

A suitable polyphenylene ether thermoplastic is poly(2,6-dimethyl-1,4-phenylene oxide) which has an empirical formula of $(C_8H_8O)_n$ where n is an integer of about 30–100. The polyphenylene ether homopolymer can be admixed with an alloying/blending resin such as a high impact polystyrene, such as poly(butadiene-styrene); and a polyamide, such as Nylon 66 either as polycaprolactam or poly(hexamethylenediamine-ad ipate). These thermoplastic materials have a specific gravity in the range of about 1.0 to 1.4. A commercially available polyphenylene is sold as NORYL resin by the General Electric Company. The most preferred NORYL resins are the NORYL 844, 888, and 1222 grades.

A suitable polyetherimide thermoplastic is poly[2,2'-bis (3,4-dicarboxyphenoxy) phenylpropane)-2-phenylene bismide] which has an empirical formula of $(C_{37}H_{24}O_6N_2)_n$ where n is an integer of about 15–27. The polyetherimide thermoplastics have a specific gravity in the range of about 1.2 to 1.6. A commercially available polyetherimide is sold as ULTEM resin by the General Electric Company. The most preferred ULTEM resin is the ULTEM 1000 grade.

A suitable polyethersulfone thermoplastic has the general empirical formula of $(C_{12}H_{16}SO_3)n$ where n is an integer of about 50–200. An example of a suitable polyethersulfone which is commercially available is sold as VICTREX PES by ICI, Inc. The most preferred of these resins is the VICTREX PES 5200 grade.

In a preferred coating method, the coating is applied in a fluidized bed process, preferably with use of a Wurster coater such as manufactured by Glatt, Inc. During the Wurster coating process, the metal-based particles are fluidized in air. The thermoplastic material is dissolved in an appropriate organic solvent and the resulting solution is sprayed through an atomizing nozzle into the inner portion of the Wurster coater, where the solution contacts the fluidized bed of iron particles. Any organic solvent for the thermoplastic material can be used, but preferred solvents are methylene chloride, 1,1,2 trichloroethane, and acetone. Blends of these solvents can also be used. The concentration of thermoplastic material in the coating solution is preferably at least 3% and more preferably about 5–10% by weight. The use of a peristaltic pump to transport the thermoplastic solution to the nozzle is preferred. The fluidized metal-based particles are preferably heated to a temperature of at least about 25° C., more preferably at least about 30° C., but below the solvent boiling point, prior to the addition of the solution of thermoplastic material. The metal-based particles are wetted by the droplets of dissolved thermoplastic, and the wetted particles are then transferred into an expansion chamber in which the solvent is removed from the particles by evaporation, leaving a substantially uniform coating of thermoplastic material around the metal-based, core particles.

The amount of thermoplastic material coated onto the metal-based particles can be monitored by various means. One method of monitoring the thermoplastic coating process is to operate the coater in a batch-wise fashion and administer the amount of thermoplastic necessary for the desired coating percentage at a constant rate during the batch cycle, with a known amount of thermoplastic in the solution being used. Another method is to constantly sample the coated particles within the fluidized bed for carbon content and correlate this to a thermoplastic coating content.

This process provides metal-based powders with a substantially uniform circumferential coating of thermoplastic material. The final physical characteristics of the coated particles can be varied by manipulation of different operating parameters during the coating process.

A preferred thermoplastic-coated iron particle is characterized by having an apparent density from about 2.4 g/cm$^3$ to about 2.7 g/cm$^3$ and a thermoplastic coating that constitutes about 0.4–2.0% by weight of the particles as coated. It has been found that components made from particles within these limits exhibit superior magnetic properties.

When the polymeric material is to be bonded to the metal-based powder particles, the polymeric material is generally provided in the form of particles, which will preferably be spherical but can be, for example, lenticular or flake-shaped. The particles are preferably fine enough to pass through a No. 60 sieve, U.S. Series (about 250 microns or less), more preferably through a No. 100 sieve (about 150 microns or less) and most preferably through a No. 140 sieve (about 105 microns or less). However, the absolute size of the polymer particles is less important than their size in relation to the size of the metal-based particles; preferably the polymer particles will be finer than the metal-based particles.

In the bonding process, the metal-based particles and polymeric particles are admixed together, preferably in dry form, by conventional mixing techniques to form a substantially homogeneous particle blend. The dry admixture is then contacted with sufficient solvent to wet the particles, and more particularly to soften and/or partially dissolve the surfaces of the polymeric particles, causing those particles to become tacky and to adhere or bond to the surfaces of the metal-based particles. Preferably the solvent is applied to the dry admixture by spraying fine droplets of the solvent during mixing of the dry blend. Most preferably mixing is continued throughout the solvent application to ensure wetting of the polymer materials and homogeneity of the final mixture. The solvent is thereafter removed by evaporation, optionally with the aid of heating, forced ventilation, or vacuum. Mixing can be continued during the solvent removal step, which will itself aid evaporation of the solvent. The initial dry blending of the particles as well as the application and removal of the solvent can be effected in conventional mixing equipment outfitted with suitable solvent application and recovery means. The conical screw mixers available from the Nauta Company can be used for this purpose.

In the bonding process, any organic solvent for the polymeric material can be used. Preferred are methylene chloride, 1,1,2-trichloroethane, and acetone. Blends of these solvents can also be used. A preferred combination for use in this invention uses a polyetherimide thermoplastic as the polymeric material and methylene chloride as the solvent. The amount of solvent applied to the dry admixture will be about 1–25 weight parts solvent per 100 weight parts of iron-based powder. Generally, however, it is more convenient to calculate the amount of solvent based on the amount of polymeric material present. In these terms, about 1.5–50 weight parts, preferably about 3–20 weight parts, more preferably about 5–10 weight parts of solvent per unit weight part of polymer, will sufficiently wet the admixture.

The amount of the polymeric material to be associated with the metal-based powder is generally about 0.001–15% by weight of the total weight of the combined weight of the metal-based particles and polymeric material, after the removal of the solvent. Preferably the polymer is at least about 0.2% by weight, up to about 5% by weight, of this combination. More preferably the polymer is about 0.4–2% by weight, and most preferably about 0.6–1.0% by weight, of the combined weight of the metal-based particles and polymer material.

In accordance with the present invention, the powder metallurgy composition is admixed with a solid lubricant component. This lubricant component comprises a solid, particulate polyether, such as those compounds having more than one subunit of a formula:

$$-[O(CH_2)_q]-$$

wherein q is from about 1 to about 7. Preferred are solid, particulate polyethers having a formula:

$$H-[O(CH_2)_q]_n-OH$$

wherein q is from about 1 to about 7 and n is selected such that the polyether has a weight average molecular weight greater than 10,000 based on rheological measurements. Preferably, q is 2 and n is selected such that the polyether has a weight average molecular weight from about 10,000 to about 4,000,000, more preferably from about 20,000 to about 3,000,000, and even more preferably from about 20,000 to about 300,000, as determined by gel permeation chromatography (GPC). One particularly preferred embodiment incorporates a polyether having a weight average molecular weight of about 100,000. The polyether is generally referred to as a polyethylene oxide when q is 2. The polyether is preferably substantially linear in structure and is an oriented polymer having a high degree of crystallinity, preferably as high as 95% crystallinity. Preferred solid, particulate polyethers are the ethylene oxide derivatives generally disclosed in U.S. Pat. No. 3,154,514 to Kelly. Particularly preferred are the CARBOWAX® 20M and POLYOX® N-10 resins, both of which are available from Union Carbide Corporation of Danbury, Conn.

The solid polyether is present in the composition in the form of discrete particles of the polyether. The weight average particle size of these particles is preferably between about 25 and 150 microns, more preferably between about 50 and about 150 microns, and even more preferably between about 70 and 110 microns. The weight average particle size distribution is preferably such that about 90% by weight of the polyether lubricant is below about 200 microns, preferably below about 175 microns, and more preferably below about 150 microns. The weight average particle size distribution is also preferably such that at least 90% by weight of the polyether particles are above about 3 microns, preferably above about 5 microns, and more preferably above about 10 microns.

The solid lubricant that is admixed with the metal powder in the practice of the invention is primarily designed to lower the ejection forces required for removing the compacted part from the die cavity. The incorporation of the solid, particulate polyether lubricant of this invention has been found to greatly improve the green strength of the compacted part, while also lowering these ejection forces. The metal-based powder compositions can contain the solid, particulate polyether lubricant of the invention as the sole internal lubricant component, or the compositions can additionally contain other, traditional internal lubricants as well. Examples of such other lubricants include stearate compounds, such as lithium, zinc, manganese, and calcium stearates commercially available from Witco Corp.; waxes such as ethylene bis-stearamides and polyolefins commercially available from Shamrock Technologies, Inc.; mixtures of zinc and lithium stearates commercially available from Alcan Powders & Pigments as Ferrolube M, and mixtures of ethylene bis-stearamides with metal stearates such as Witco ZB-90. It has been found that the beneficial green strength improvements resulting from the incorporation of the solid, particulate polyether compound as part of the solid lubricant component of the powder composition are generally proportional to the amount of the polyether relative to any other internal lubricants. Thus, it is preferred that the polyether generally constitute at least about 10%, preferably at least about 30%, more preferably at least about 50%, and even more preferably at least about 75%, by weight of the solid, internal lubricant present in the metallurgical composition. In most preferred embodiments, the solid particulate lubricant of the invention is at least 90% or 100% by weight of the lubricant present in the composition.

The solid lubricant is generally blended into the metallurgical powder composition in a minor amount, and generally in an amount of from about 0.05 to about 10 percent by weight. Preferably, the solid lubricant constitutes about 0.3–5%, more preferably about 0.5–2.5%, and even more preferably about 0.7–2%, by weight of the powder composition.

In certain embodiments, the powder composition also comprises a plasticizer as a portion of the solid lubricant component. Representative plasticizers are generally disclosed by R. Gachter and H. Muller, eds., Plastics Additives Handbook (1987) at, for example, pages 270–281 and 288–295. These include alkyl, alkenyl, or aryl esters wherein the alkyl, alkenyl, and aryl moieties have from about 1 to about 10 carbon atoms, from about 1 to about 10 carbon atoms, from about 6 to about 30 carbon atoms, respectively, phthalic acid, phosphoric acid, and dibasic acid. Preferred esters are alkyl esters, such as di-2-ethylhexyl phthalate (DOP), di-iso-nonyl phthalate (DINP), dibutyl phthalate (DBP), trixylenyl phosphate (TCP), and di-2-ethylhexyl adipate (DOA). DBP and DOP are particularly preferred plasticizers. The plasticizers can be incorporated into the metallurgical powder compositions in an amount of from about 0.1 to about 25 percent of the weight of the solid lubricant component.

The components of the metallurgical powder compositions of the invention can be prepared following conventional powder metallurgy techniques in a manner that retains the polyether lubricant in particulate form in the final mixture. Generally, the metal powder having the polymeric material associated therewith and the solid lubricant are admixed together using conventional powder metallurgy techniques, such as the use of a double cone blender. The blended powder composition is then ready for use.

The iron/polymer powder compositions made by the method of this invention can be formed into magnetic cores by an appropriate molding technique. In preferred embodiments, a compression molding technique, in which the powder composition is charged into a die and heated to a temperature above the glass transition temperature of the thermoplastic material, is used to form the magnetic components. Preferably, the die and composition are heated to a temperature that is about 25–85 Centigrade degrees above the glass transition temperature. Normal powder metallurgy pressures are applied at the indicated temperatures to press out the desired component. Typical compression molding techniques employ compaction pressures of about 5–100 tons per square inch (69–1379 MPa), preferably in the range of about 30–60 tsi (414–828 MPa). A die wall lubricant can be used during the compaction process.

Following the compaction step, the molded component is optionally heat treated. According to this procedure, the molded component, preferably after removal from the die and after being permitted to cool to a temperature at least as low as the glass transition temperature of the polymeric material, is separately heated to a "process" temperature that is above the glass transition temperature, preferably to a temperature up to about 140 Centigrade degrees above the temperature at which the component was compacted. The molded component is maintained at the process temperature for a time sufficient for the component to be thoroughly heated and its internal temperature brought substantially to the process temperature. Generally, heating is required for about 0.5–3 hours, depending on the size and initial temperature of the pressed part. The heat treatment can be conducted in air or in an inert atmosphere such as nitrogen.

EXAMPLE

The following example, which is not intended to be limiting, presents an embodiment and certain advantages of the present invention. Unless otherwise indicated, any percentages are on a weight basis.

Physical properties of powder mixtures and of the green bars were determined generally in accordance with the following test methods and formulas:

| Property | Test Method |
|---|---|
| Apparent Density (g/cc) | ASTM B212-76 |
| Flow (sec/50 g) | ASTM B213-77 |
| Green Density (g/cc) | ASTM B331-76 |
| Green Strength (psi) | ASTM B312-76 |

Strip pressure measures the static friction that must be overcome to initiate ejection of a compacted part from a die. It was calculated as the quotient of the load needed to start the ejection over the cross-sectional area of the part that is in contact with the die surface, and is reported in units of psi.

Slide pressure is a measure of the kinetic friction that must be overcome to continue the ejection of the part from the die cavity; it is calculated as the quotient of the average load observed as the part traverses the distance from the point of compaction to the mouth of the die, divided by the surface area of the part, and is reported in units of psi.

Various powder mixtures were prepared containing minor amounts of a polyethylene oxide (wt. avg. MW=100,000, avg. particle size=110 $\mu$m) blended with an iron-based powder (Hoeganaes' A1000C powder), which was coated by way of a Wurster coater with 0.25% wt. Ultem polyetherimide resin. Four mixtures were prepared containing 0.25%, 0.5%, 0.75%, and 1% by weight polyethylene oxide, with a correspondingly decreasing amount of the thermoplastic-coated iron-based powder of 99.75%, 99.5%, 99.25%, and 99% by weight, respectively.

The powder properties for the mixtures are shown in Table 1.

TABLE 1

| Powder Properties | 0% MIX | 0.25% Mix | 0.5% Mix | 0.75% Mix | 1% Mix |
|---|---|---|---|---|---|
| A.D. | 2.70 | 3.00 | 2.96 | 2.91 | 2.89 |
| Flow | 29.2 | 25.53 | 23.97 | 24.57 | 24.69 |

The compaction properties of the green bars are shown in Table 2. The bars were compacted at a pressure of 50 tons per square inch (tsi) at a die temperature of about 145° F.

Significantly, the green strength of the bar increased with the higher additions of the lubricant, reaching a maximum near the 0.75% addition level. The incorporation of the polyethylene oxide lubricant resulted in a powder composition that can be compacted into parts having significantly higher green strengths that are also easier to remove from the die as shown by the lower ejection forces.

TABLE 2

| GREEN PROPERTIES | 0% MIX | 0.25% Mix | 0.5% Mix | 0.75% MIX | 1% MIX |
|---|---|---|---|---|---|
| GREEN DENSITY | 7.20 | 7.37 | 7.37 | 7.36 | 7.31 |
| GREEN STRENGTH | 4200 | 7300 | 8200 | 8700 | 8400 |
| STRIPPING PRESSURE | 6500 | 5900 | 4900 | 4100 | 3500 |
| SLIDING PRESSURE | 5700 | 4000 | 2400 | 1800 | 1400 |

What is claimed is:

1. A method for preparing a metallurgical powder composition having a polymeric material associated therewith wherein the composition comprises:

(a) a major amount of a metal-based powder having a weight average particle size in the range of about 25–350 microns;

(b) a minor amount of a polymeric material associated with the metal-based powder, the polymeric material comprising polyetherimides, polyphenylene ethers, polyethersulfones, polycarbonates, polyethylene glycols, polyvinyl acetates, or polyvinyl alcohols; and (c) a minor amount of a solid compaction lubricant comprising at least about 30 percent by weight of a solid, particulate polyether having a formula:

$$H—[O(CH_2)_q]_n—OH$$

where q is from about 1 to about 7, and n is selected such that the polyether has a weight average molecular weight between about 10,000 and about 4,000,000, wherein said polyether has a weight average particle size between about 25 and 150 microns;

wherein the method comprises the steps of:

(i) contacting said metal-based powder particles with the polymeric material in the presence of a solvent for the polymeric material;

(ii) removing the solvent to form a polymeric-metal powder having the plastic material associated with the metal-based powder particles; and (iii) admixing the solid compaction lubricant with the polymeric-metal powder.

2. The method of claim 1 wherein the polyether comprises polyethylene oxide present in an amount of at least 10 percent by weight of said solid lubricant, and wherein said polymeric material is present in an amount of from about 0.001 to about 15 percent by weight of the metal-based powder.

3. The method of claim 2 wherein said metal-based powder is an iron-based powder.

4. The method of claim 3 wherein said solid lubricant is present in an amount of from about 0.3 to about 10 percent by weight of the powder composition, and the polymeric material is present in an amount of from about 0.1 to about 2 percent by weight of the metal-based powder.

5. The method of claim 4 wherein said polyethylene oxide is present in an amount of at least 30 percent by weight of said solid lubricant.

6. The method of claim 4 wherein said polyethylene oxide constitutes at least 50 percent by weight of said solid lubricant.

7. A method for the manufacture of a compacted metal part, comprising:

(a) providing a metallurgical powder composition comprising (i) a major amount of a metal-based powder having a weight average particle size in the range of about 25–350 microns;

(ii) a minor amount of a polymeric material associated with the metal-based powder, the polymeric material comprising polyetherimides, polyphenylene ethers, polyethersulfones, polycarbonates, polyethylene glycols, polyvinyl acetates, or polyvinyl alcohols; and (iii) a minor amount of a solid compaction lubricant comprising at least about 30 percent by weight of a solid, particulate polyether having the formula:

$$H—[O(CH_2)_q]_n—OH$$

where q is from about 1 to about 7, and n is selected such that the polyether has a weight average molecular weight between about 10,000 and about 4,000,000, wherein said polyether has a weight average particle size between about 25 and 150 microns; and (b) compressing said powder composition in a die at elevated pressures to form a compacted part.

8. The method of claim 7 wherein the polyether comprises polyethylene oxide present in an amount of at least 10 percent by weight of said solid lubricant, and wherein said polymeric material is present in an amount of from about 0.001 to about 15 percent by weight of the metal-based powder.

9. The method of claim 8 wherein said metal-based powder is an iron-based powder.

10. The method of claim 9 wherein said solid lubricant is present in an amount of from about 0.3 to about 10 percent by weight of the powder composition, and the polymeric material is present in an amount of from about 0.1 to about 2 percent by weight of the metal-based powder.

11. The method of claim 10 wherein said polyethylene oxide is present in an amount of at least 30 percent by weight of said solid lubricant.

12. The method of claim 10 wherein said polyethylene oxide constitutes at least 50 percent by weight of said solid lubricant.

* * * * *